US009265334B1

(12) United States Patent
Fung-A-Wing

(10) Patent No.: US 9,265,334 B1
(45) Date of Patent: Feb. 23, 2016

(54) BOTTLE BRUSH

(71) Applicant: Rekemo Fung-A-Wing, Kennesaw, GA (US)

(72) Inventor: Rekemo Fung-A-Wing, Kennesaw, GA (US)

( * ) Notice: Subject to any disclaimer, the term of this patent is extended or adjusted under 35 U.S.C. 154(b) by 0 days.

(21) Appl. No.: 14/518,203

(22) Filed: Oct. 20, 2014

(51) Int. Cl.

| | |
|---|---|
| ***A46B 5/02*** | (2006.01) |
| ***A46B 15/00*** | (2006.01) |
| ***A47L 17/00*** | (2006.01) |
| ***A46B 5/00*** | (2006.01) |
| ***A47L 13/12*** | (2006.01) |

(52) U.S. Cl.
CPC ..... *A46B 5/0008* (2013.01); *A46B 5/02* (2013.01); *A46B 15/0097* (2013.01); *A47L 13/12* (2013.01); *A46B 5/0016* (2013.01); *A46B 5/0095* (2013.01); *A46B 15/0055* (2013.01); *A46B 2200/3006* (2013.01); *A47L 17/00* (2013.01)

(58) Field of Classification Search
CPC ..... A47L 17/00; A47L 17/04; A46B 5/0004; A46B 5/0008; A46B 5/0016; A46B 15/0055; A46B 15/0097; A46B 2200/30; A46B 2200/3006; A46B 2200/3013; A46B 2200/3033
USPC ..... 15/105, 106, 114, 164, 206, 211; D4/116, 119, 120, 127, 128, 130–133, D4/138; D32/35, 40, 42, 51, 52
See application file for complete search history.

(56) References Cited

U.S. PATENT DOCUMENTS

| | | | | |
|---|---|---|---|---|
| 3,451,723 | A | 6/1969 | Marks | |
| D250,068 | S * | 10/1978 | Ducotey | D4/119 |
| 5,306,151 | A * | 4/1994 | Rauch | 433/216 |
| 5,491,863 | A | 2/1996 | Dunn | |
| 5,621,941 | A | 4/1997 | Liu | |
| 5,709,003 | A * | 1/1998 | Batch | 15/106 |
| 6,202,247 | B1 | 3/2001 | Lorenz, Jr. | |
| D489,536 | S | 5/2004 | Dunn | |
| D489,903 | S | 5/2004 | Dunn | |
| 6,892,416 | B2 | 5/2005 | Lee et al. | |
| 7,017,222 | B2 | 3/2006 | Dunn | |
| 7,260,862 | B1 | 8/2007 | DeFilippis | |
| 7,473,046 | B2 * | 1/2009 | Kraus et al. | 401/117 |

* cited by examiner

*Primary Examiner* — Mark Spisich
(74) *Attorney, Agent, or Firm* — Robert M. Downey, P.A.

(57) ABSTRACT

A bottle brush cleaning device includes a container cleaning element, a nipple cleaning element, and one or more additional cleaning elements. Each cleaning element extends from an ergonomically shaped base that is easy to grasp with one hand and manipulate use of each of the cleaning elements. In one embodiment, the ergonomically shaped base is configured to be placed upright on a supporting surface such that each of the cleaning elements is at least semi-vertically positioned away from the supporting surface in order to air dry without contamination from contact with other objects or surfaces. In a preferred embodiment, two additional cleaning elements extend from the base, wherein the additional cleaning elements each include brushes having dissimilarly sized diameters in order to allow for cleaning of varyingly sized articles, such as a straw or other tubular-shaped article.

13 Claims, 4 Drawing Sheets

BOTTLE BRUSH

BACKGROUND OF THE INVENTION

1. Field of the Invention

The present invention relates to brushes for cleaning bottles and, more particularly, to a multi-element brushing device for cleaning each of the multiple components of a bottle.

2. Discussion of the Related Art

The are a number of different, well known types of baby bottles; however, each bottle configuration typically includes a container component for storing infant formula, expressed breast milk or other liquid, and a nipple component that is sealable to the container component. Moreover, there are particular embodiments of baby bottles that include a straw component extending within the interior of the container component and being in communication with the nipple component. Baby bottles are generally reusable and must therefore be cleaned between uses. The process of cleaning the different components of a baby bottle can be cumbersome due to the relatively confined spaces included in each of the components.

There have been attempts to create a bottle and nipple brush in the past in an effort to provide a sufficient bottle cleaning device. For example, U.S. Pat. No. 5,491,863 to Dunn discloses a combined bottle and nipple cleaning brush utensil. The Dunn nipple cleaning brush is storable within the handle portion of the brush, which can promote growth of bacteria and mold. Moreover, the Dunn utensil does not provide a cleaning brush suitable for cleaning a straw component of a bottle. While the Dunn brush utensil and other cleaning brushes are not without merit, there exists a need for a bottle brush cleaning device having a combination of at least three different types of brushes, including a container cleaning element, a nipple cleaning element, and one or more additional cleaning elements, and wherein each of the cleaning elements extend from an ergonomically shaped base that is easy to grasp with one hand and manipulate use of each of the cleaning elements without having to place down the device or reposition one's grip on the device.

OBJECTS AND ADVANTAGES OF THE INVENTION

It is an object of the present invention to provide a multi-purpose brush device for cleaning baby bottles, nipples, straws, child sippy cups and other articles, and wherein the brush device has two or more different brushes that remain completely exposed at all times, thereby allowing for ease of use and air drying without growth of mildew and bacteria.

It is another object of the present invention to provide a multi-purpose brush device that has two or more different size brushes for cleaning baby bottles, breast pumps, child sippy cups and other articles without the need to put the device down and pick up items to be cleaned.

It is yet another object of the present invention to provide a multi=purpose brush device that stands on its own, thereby allowing for fast drying without while avoiding contact with counter-tops or dirty dishes in a sink.

It is yet a further object of the present invention to provide a multi-purpose brush device that can be used to clean many different items without the need of putting the brush down or having to pick up another brush to use on a separate item being cleaned.

These and other objects and advantages will be readily apparent with reference to the following description and accompanying drawings.

SUMMARY OF THE INVENTION

The present invention is directed to a bottle brush cleaning device including a container cleaning element, a nipple cleaning element, and one or more additional cleaning elements. Each cleaning element extends from an ergonomically shaped base that is easy to grasp with one hand and manipulate use of each of the cleaning elements. In one embodiment, the ergonomically shaped base is configured to be placed upright on a supporting surface such that each of the cleaning elements is at least semi-vertically positioned away from the supporting surface in order to air dry without contamination from contact with other objects or surfaces. In a preferred embodiment, two additional cleaning elements extend from the base, wherein the additional cleaning elements each include brushes having dissimilarly sized diameters in order to allow for cleaning of varyingly sized articles, such as a straw or other tubular-shaped article.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the bottle brush cleaning device of the present invention is shown and is generally indicated as 10.

Figure 1:
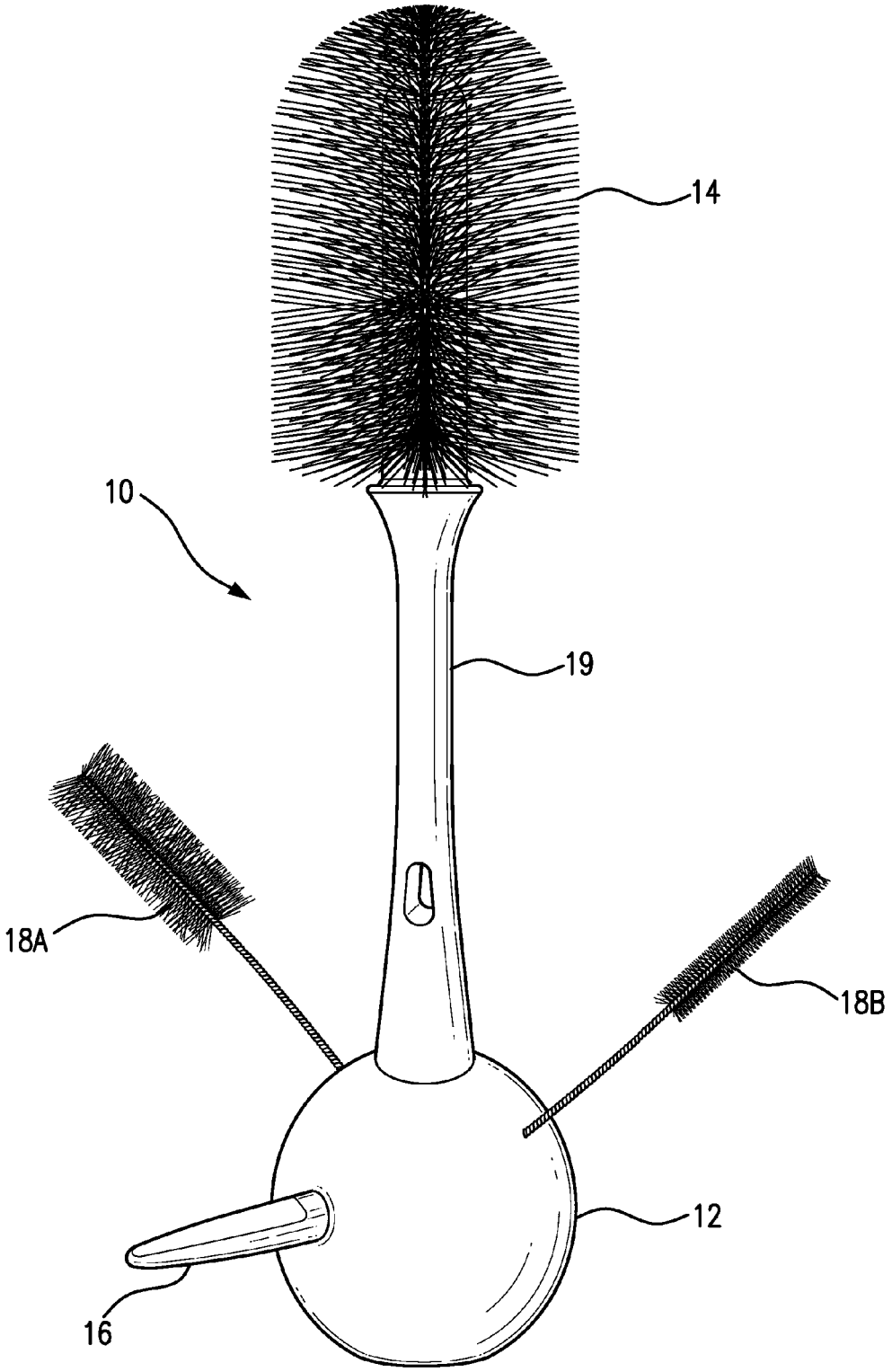
FIG. 1 is a perspective view of the bottle brush cleaning device of the present invention according to one embodiment, illustrating the ergonomically shaped base standing upright on a supporting surface with a container cleaning element, a nipple cleaning element, and two additional cleaning elements extending at least semi-vertically therefrom.

Referring initially to FIG. 1, the bottle brush cleaning device 10 includes an ergonomically shaped base 12 that is sized and configured to be grasped in the hand of a user. A container cleaning element 14, a nipple cleaning element 16, and two additional cleaning elements 18A and 18B extend outwardly from the base 12. In one embodiment, the additional cleaning elements 18A and 18B are brushes having dissimilarly sized diameters each being sized and configured for engaging and cleaning the interior surfaces of tubular-shaped articles, such as a straw. Each cleaning element 14, 16, 18A and 18B may be fixed to a stem portion 19 extending outwardly from the base 12 (as shown with container cleaning element 14 in FIG. 1). The ergonomically shaped base 12 is configured to permit the user to grasp the base 12 with one hand and manipulate each of the cleaning elements 14, 16, 18A and 18B without setting down the device 10 or repositioning his or her hand grip on the base 12. In one embodiment, the base 12 includes a flat bottom end 20 (FIGS. 3 and 4) that permits the device 10 to stand upright on a supporting surface wherein the container cleaning element 14, the nipple cleaning element 16, and two additional cleaning elements 18A and 18B extend at least semi-vertically from the base 12 such that each of the cleaning elements 14, 16, 18A and 18B do not touch the surface in order to allow the cleaning the device 10 to air dry without contamination from contact with other objects or surfaces. Alternatively, the ergonomically shaped base 12 may be sized for use in conjunction with a drying structure configured to support the device 10 in an upright position.

Figure 2:
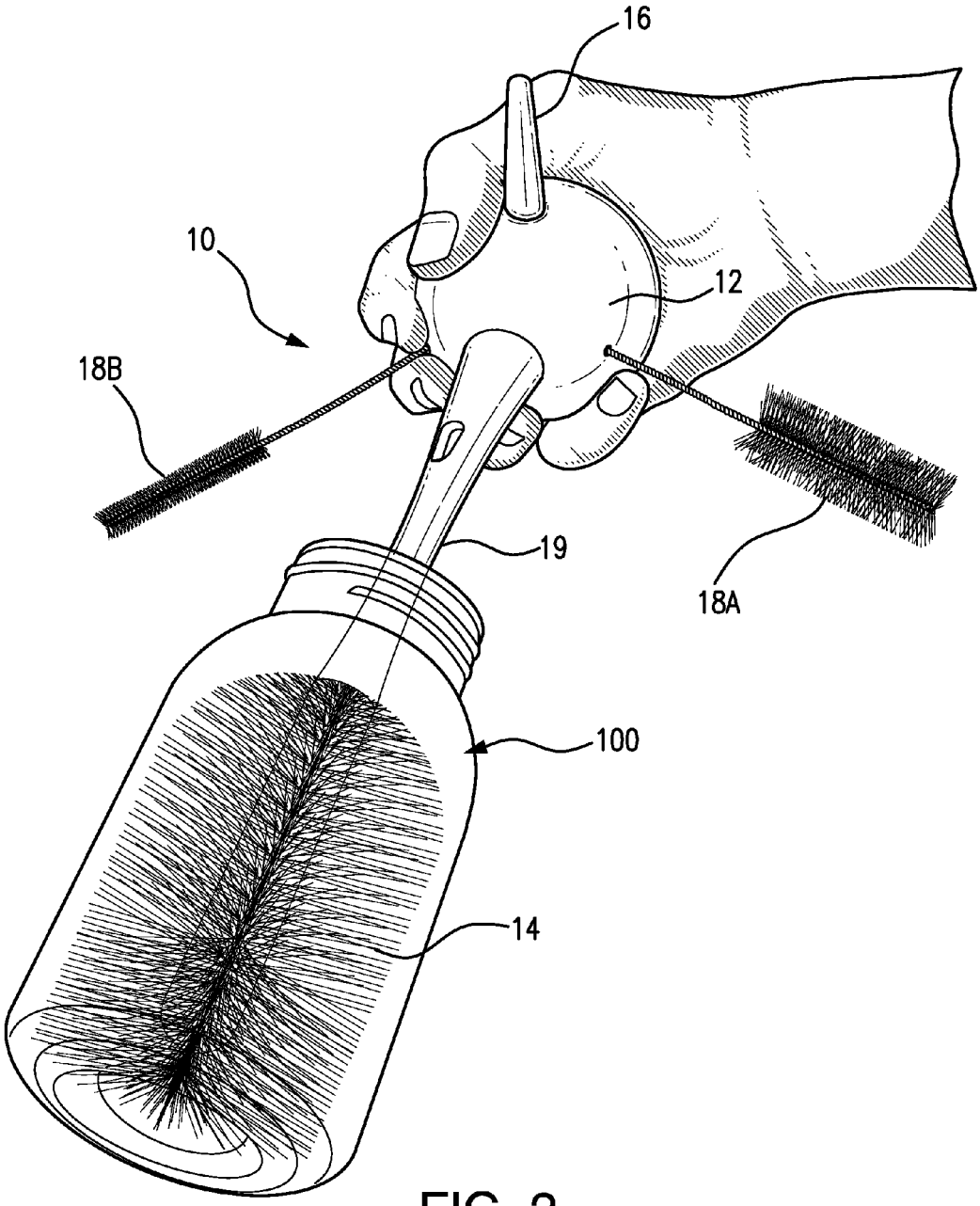
FIG. 2 is a perspective view of the bottle brush cleaning device of the present invention in use, wherein the ergonomically shaped base is held in the hand of a user and the container cleaning element is being manipulated to clean the inner surfaces of the container component of a bottle.

Referring to FIG. 2, the device 10 is shown in use, wherein the base 12 is held in the hand of a user and the container cleaning element 14 is cleaning the interior surfaces of a container 100 of a bottle. The container cleaning element 14 includes a radiating array of bristles that are semi-rigid to permit insertion through the container opening and into the interior cavity of the container 100 for scrubbing the interior surfaces of the container 100.

Figure 3:
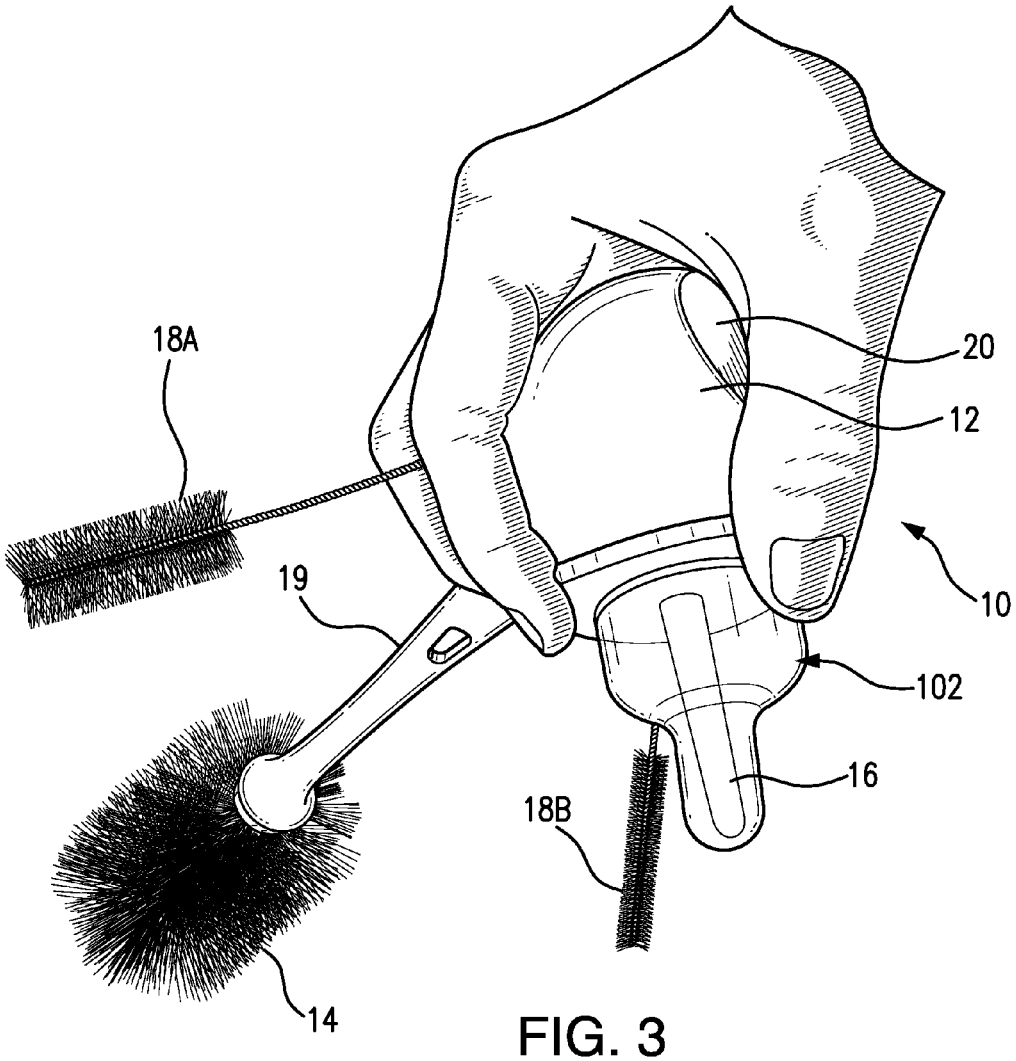
FIG. 3 is a perspective view of the bottle brush cleaning device of the present invention in use, wherein the ergonomically shaped base is held in the hand of a user and the nipple cleaning element is being manipulated to clean the inner surfaces of the nipple component of a bottle.

Referring to FIG. 3, the nipple cleaning element 16 is shown in use for cleaning a nipple portion 102 of a bottle, wherein the base 12 is held by the hand of a user. In one embodiment, the nipple cleaning element 16 may also be used for cleaning the exterior surfaces of the nipple portion 102. The nipple cleaning element 16 may be made from a polyurethane foam material, bristle material, or other suitable brush material.

Figure 4:
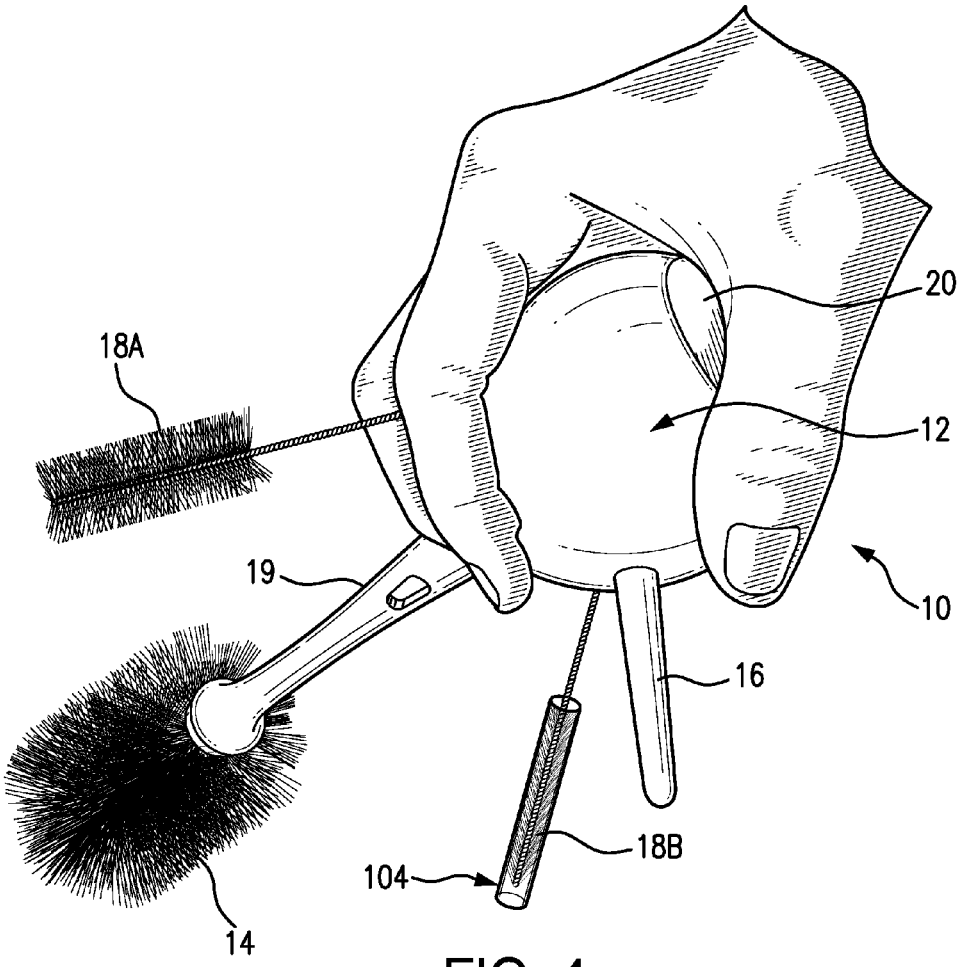
FIG. 4 is a perspective view of the bottle brush cleaning device of the present invention in use, wherein the ergonomically shaped base is held in the hand of a user and one of the additional cleaning elements is being manipulated to clean the inner surfaces of the straw component of a bottle.

Referring to FIG. 4, the additional cleaning element 18B is shown in use, wherein the cleaning element 18B has been inserted into a tubular-shaped article 104 for cleaning the interior surfaces of the tubular-shaped article 104. The base 12 is shown being held in the same position as used when operating the nipple cleaning element 16 (as shown in FIG. 3). Each of the cleaning elements 14, 16, 18A and 18B may be operated while holding the base 12 in the same hand grip position and without the need to reposition one's grip.

In one embodiment, one or more of the cleaning elements 14, 16, 18A and 18B are replaceable, wherein a worn or otherwise defective cleaning element 14, 16, 18A or 18B is removed from the base 12 and replaced with a like cleaning element 14, 16, 18A or 18B.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A cleaning device comprising:

a base portion defining a handle that is sized, structured and configured for ergonomically grasping in one hand of a user;

a main stem extending upwardly from said base portion along a first radial axis to a distal end portion;

a first brush element on said distal end portion, and said first brush element including a radiating array of bristles structured and disposed to be inserted into a container for cleaning interior surfaces of the container;

a second brush element fixed to and extending upwardly from said base portion along a second radial axis that is angled relative to the first radial axis so that said first brush element and said second brush element are independently usable while maintaining the same ergonomic grasp of the base portion in the one hand of the user; and said base portion being structured and disposed to be supported upright on a support surface when not in use with said first brush element and said second brush element surrounded by air and free from contact with any objects or surfaces, thereby allowing said first and second brush elements to air dry without contamination from contact with other objects or surfaces.

2. The cleaning device as recited in claim 1 further comprising:

at least a third brush element fixed to and extending outwardly from said base portion along a third radial axis that is angled relative to the first radial axis and the second radial axis so that said first brush element, said second brush element and said third brush element are independently usable while maintaining the same ergonomic grasp of the base portion in the one hand of the user; and said third brush element extending outwardly from said base portion and surrounded by air and free from contact with any objects or surfaces when said cleaning device is supported upright on the support surface when not in use, and thereby allowing said third brush element to air dry without contamination from surface contact.

3. The cleaning device as recited in claim 2 further comprising:

at least a fourth brush element fixed to and extending outwardly from said base portion along a fourth radial axis that is angled relative to the first radial axis, the second radial axis and the third radial axis so that said first brush element, said second brush element, said third brush element and said fourth brush element are independently usable while maintaining the same ergonomic grasp of the base portion in the one hand of the user; and said fourth brush element extending outwardly from said base portion and surrounded by air and free from contact with any objects or surfaces when said cleaning device is supported upright on the support surface when not in use, and thereby allowing said fourth brush element to air dry without contamination from surface contact.

4. The cleaning device as recited in claim 1 wherein said base portion includes a flat bottom surface that is configured to allow for congruent abutment against the support surface such that said cleaning device is supported upright thereon when not in use.

5. A cleaning device comprising:

a base portion that is sized, structured and configured for grasping in one hand of a user;

a main stem extending from said base portion to a distal end portion;

a first brush element on said distal end portion, and said first brush element including a radiating array of bristles structured and disposed to be inserted into a container for cleaning interior surfaces of the container;

a second brush element fixed to and extending from said base portion defining a nipple brush that is structured and disposed for cleaning interior and exterior surfaces of baby bottle nipples;

at least a third brush element fixed to and extending outwardly from said base portion and being structured and disposed for inserting into tubular members for cleaning surrounding interior surfaces thereof; and said cleaning device being structured and disposed to be supported upright on a support surface when not in use with said first brush element, said second brush element and said third brush element surrounded by air and free from contact with any objects or surfaces, thereby allowing said first, second and third brush elements to air dry without contamination from contact with other objects or surfaces.

6. The cleaning device as recited in claim 5 further comprising:

at least a fourth brush element fixed to and extending outwardly from said base portion and being structured and disposed for inserting into tubular members for cleaning surrounding interior surfaces thereof;

said fourth brush element extending outwardly from said base portion and surrounded by air and free from contact with any objects or surfaces when said cleaning device is supported upright on the support surface when not in use, and thereby allowing said fourth brush element to air dry without contamination from surface contact; and said fourth brush element having a diameter that is larger than the diameter of said third brush element.

7. The cleaning device as recited in claim 5 wherein said base portion includes a flat bottom surface that is configured to allow for congruent abutment against the support surface such that said cleaning device is supported upright thereon when not in use.

8. The cleaning device as recited in claim 5 wherein said second brush element is made from polyurethane foam.

9. The cleaning device as recited in claim 5 wherein each of said first, second and third brush elements is replaceable.

10. A cleaning device comprising:

a base portion that is sized, structured and configured for grasping in one hand of a user;

a main stem extending from said base portion to a distal end portion;

a first brush element on said distal end portion, and said first brush element including a radiating array of bristles structured and disposed to be inserted into a container for cleaning interior surfaces of the container;

a second brush element fixed to and extending from said base portion defining a nipple brush that is structured and disposed for cleaning interior and exterior surfaces of baby bottle nipples;

at least a third brush element fixed to and extending outwardly from said base portion and being structured and disposed for inserting into tubular members for cleaning surrounding interior surfaces thereof;

at least a fourth brush element fixed to and extending outwardly from said base portion and being structured and disposed for inserting into tubular members for cleaning surrounding interior surfaces thereof; and said cleaning device being structured and disposed to be supported upright on a support surface when not in use with said first brush element, said second brush element, said third brush element and said fourth brush element surrounded by air and free from contact with any objects or surfaces, thereby allowing said first, second, third and fourth brush elements to air dry without contamination from contact with other objects or surfaces.

11. The cleaning device as recited in claim 10 wherein said base portion includes a flat bottom surface that is configured to allow for congruent abutment against the support surface such that said cleaning device is supported upright thereon when not in use.

12. The cleaning device as recited in claim 10 wherein said second brush element is made from polyurethane foam.

13. The cleaning device as recited in claim 10 wherein each of said first, second, third and fourth brush elements is replaceable.

* * * * *